US005246393A

United States Patent [19]

von der Stein

[11] Patent Number: 5,246,393

[45] Date of Patent: Sep. 21, 1993

[54] RUDDER PROPELLER WITH NOZZLE

[76] Inventor: Norbert von der Stein, Drosselweg 59, 5042 Erftstadt-Lechenich, Fed. Rep. of Germany

[21] Appl. No.: 851,013

[22] Filed: Mar. 13, 1992

[51] Int. Cl.[5] ..... B63H 1/16

[52] U.S. Cl. ..... 440/67; 114/151

[58] Field of Search ..... 114/144 B, 144 R, 151; 440/53, 54, 57, 66, 67, 68, 69, 70

[56] References Cited

U.S. PATENT DOCUMENTS 3,734,050 11/1979 Kitai et al. ..... 440/67

4,175,511 11/1979 Krautkremer ..... 440/54

*Primary Examiner*—Jesus D. Sotelo

*Attorney, Agent, or Firm*—Fiddler Levine & Mandelbaum

[57] ABSTRACT

The nozzle ring associated with the propeller and rotatable together with it around the vertical axis is designed as a partially open annulus and arranged such that the inner circle of the nozzle—and consequently practically the wing tip circle as well—approximately touches the respective local separating surface between the flow and the floating body or boat.

8 Claims, 4 Drawing Sheets

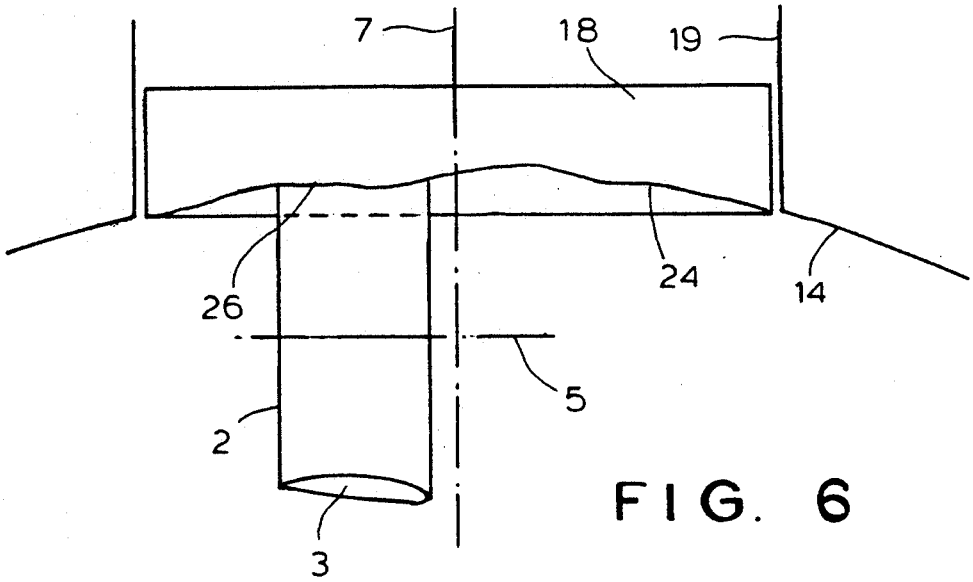
FIG. 6
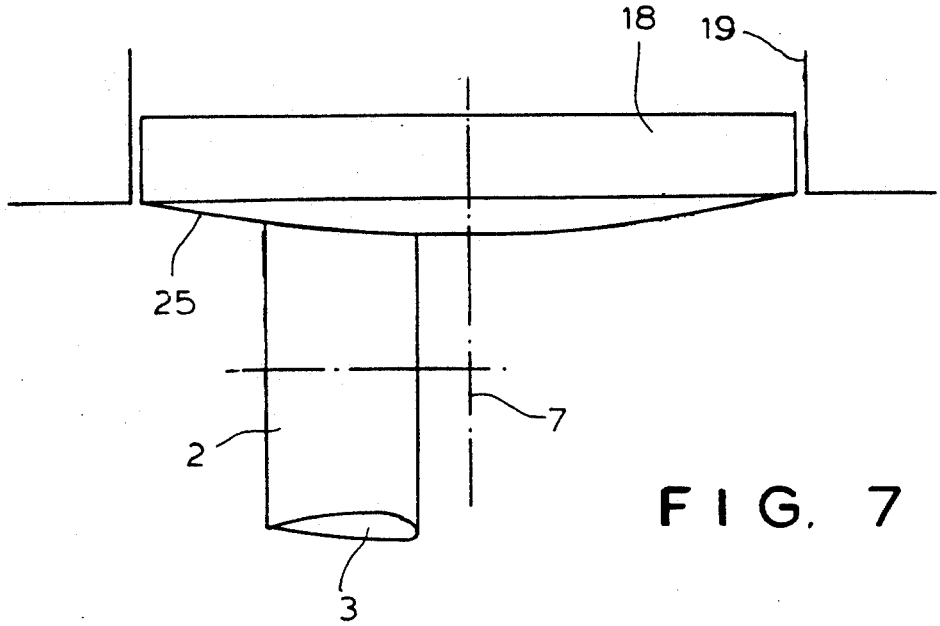
FIG. 7
FIG. 11
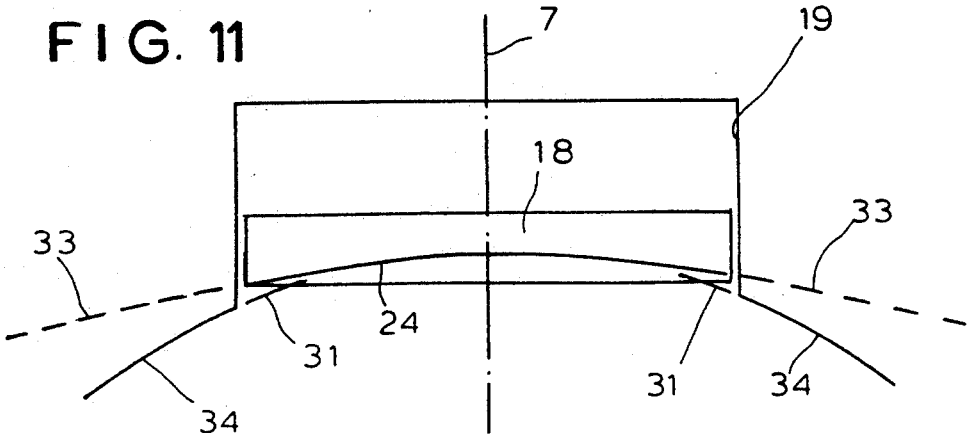

RUDDER PROPELLER WITH NOZZLE

BACKGROUND OF THE INVENTION

The present invention pertains to a rudder propeller for boats or floating bodies, especially for inland navigation vessels with an associated nozzle as a casing to form a hydrodynamic drive rotatable around a vertical axis, as well as a control device, wherein the rudder propeller is arranged on the hull beneath the boat bottom or in a propeller tunnel, and the drive power is transmitted through an essentially vertically arranged stem by means of a shaft to a bevel gear which is located in a hub pivotable with the stem around the vertical axis, and drives an approximately horizontal propeller shaft. Such rudder propellers, which are also designated as so-called azimuthal propellers, are known in the art. The propeller is arranged pivotably around a vertical axis for changing or maintaining course, as well as for stopping and reversing direction of travel.

In boats intended for limited depths of water, the boat bottom is made higher in the range of the propeller than the part of the boat bottom located at the level of the baseline, so that the lower wing tip of the propeller is only slightly below the baseline if at all.

Protection of the propeller from touching the ground is absolutely necessary for inland navigation vessels. To achieve this, the boat bottom in the range of the propeller is often designed in the form of a tunnel, whose greatest curvature, being the apex, is often so high above the water line that the propeller does not cut below the baseline of the boat bottom.

In the case of draft limitation, one basic problem of the arrangement of the drive is that only propellers whose diameter is smaller than the optimal diameter for efficiency can be accommodated in the space of limited height between the baseline and the greatest possible tunnel height determined according to hydrodynamic and practical criteria in the particular case. Since, propeller efficiency increases with increasing diameter and decreases with rising thrust coefficient in the load range involved, it is necessary to accommodate the largest possible propeller diameter, especially in the case of high-load propellers. This also applies to the case in which the propellers have an annular casing with an airplane wing-like nozzle profile, which is known, e.g., as a Kort nozzle, to improve efficiency.

Prior-art arrangements of rudder propellers with nozzles have the shortcoming that the nozzle ring fastened to the stem of the propeller rotates with the propeller around the azimuthal axis and the nozzle ring is at the same time designed as a full ring within the tunnel height. As a result, the apex of the tunnel is not touched by the inner circle of the nozzle, but the inner circle lies markedly lower. At equal tunnel height, the internal diameter of the nozzle ring and consequently also the diameter of the propeller are therefore substantially reduced, and the efficiency of the propeller is therefore relatively low.

In contrast, the upper sector of the nozzle ring, which is designed completely annulary, offers hardly any advantage, because circulation around the nozzle profile and consequently the effect of the nozzle are highly insufficient there due to the components of the vertical stem and the proximity of the tunnel wall.

Due to these disadvantages and the resulting reduction of efficiency, the use of a rudder propeller with a nozzle, which is advantageous because of its special maneuverability and for other reasons, is highly limited, especially in heavily loaded tunnel boats, and is used relatively rarely, for example, in push boats, in which the elimination of very extensive stearing gears would be highly advantageous.

SUMMARY OF THE INVENTION

The task of the present invention is to improve a design of this class and to provide an arrangement for the largest possible propeller diameter while maintaining a harmonic, hydrodynamically favorable installation space, which guarantees a relatively high propulsive efficiency of the propeller/nozzle/boat system and permits highly loadable units to be built.

This task is accomplished according to the present invention by arranging a nozzle with its associated propeller rotatably around the vertical axis as a partial nozzle ring in the flow domain and designing the partially nozzle ring such that the inner circle of the nozzle approximately touches a separating surface between the floating body and the flow guided along it, and by the wing tip circle of the propeller also being approximately tangential to the separating surface.

The shape of the separating surface must not be determined from consideration of water tightness, but from the way the flow follows the shape of the boat bottom or tunnel, i.e., even a cover of a depression or opening that is not watertight may be part of the separating surface.

This tangential arrangement of the nozzle inner circle permits optimal utilization of the installation space available, because the upper nozzle sector, which is practically useless for the circulation flow, is eliminated, and the height gained is utilized to enlarge the propeller diameter and/or to make the tunnel flatter.

Further designs for arranging the nozzle as a partial nozzle ring and for influencing the flow, including the associated design of the tunnel or shell plating, are characterized by the features of the dependent claims.

DESCRIPTION OF THE DRAWINGS

The drawings show schematically exemplary embodiments of the present invention.

FIG. 6 shows an embodiment with a concave bottom surface, corresponding to FIG. 5, but in combination with a partial convex bulge;

FIG. 7 shows an alternative embodiment corresponding to FIG. 5, with a convex bottom surface;

FIG. 11 shows a cross section of a propeller tunnel with a rotary table with concavely recessed bottom and segmental guide plates to compensate for the different curvatures in the longitudinal and transverse directions.

DESCRIPTION OF THE PREFERRED EMBODIMENT

Figure 1:
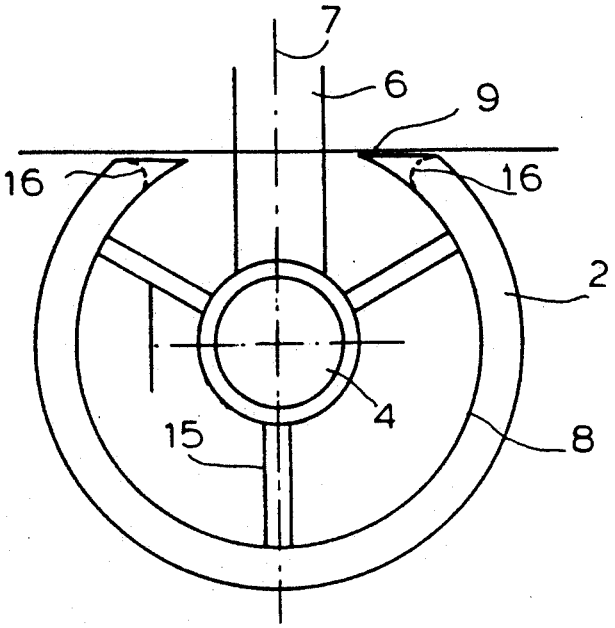
FIG. 1 shows a view of a rudder propeller with a nozzle according to the present invention in tangential arrangement.

In the arrangements shown, a propeller 1 is arranged with a partial nozzle ring 2, which has a corresponding nozzle profile 3. The propeller 1 is arranged on a hub 4 with a horizontal propeller shaft 5 and is driven through a stem 6 by a bevel gear, wherein stem 6 is rotatable around a vertical axis 7 to adjust the propeller 1 with the nozzle ring 2.

The propeller 1 and the nozzle designed as a partial nozzle ring 2 are arranged such that the inner circle of the nozzle 8 or the wing tip circle of the propeller 1, which is nearly identical to it, touches the respective separating surface 9 between the flow and the hull approximately tangentially.

Figure 2:
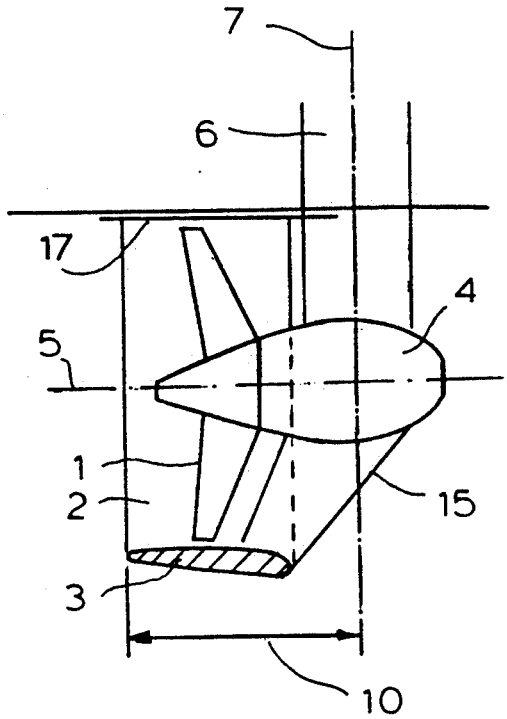
FIG. 2 shows a side view of a propeller arrangement with a plate-shaped fastening element for the nozzle at its ends.
Figure 4:
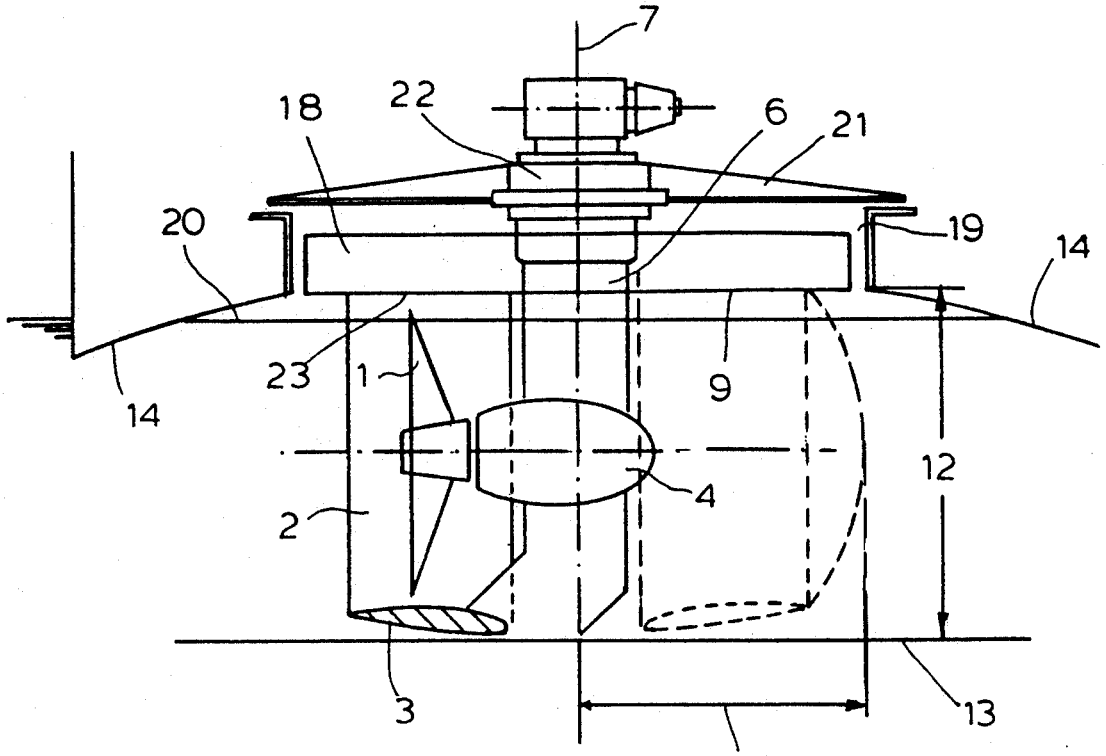
FIG. 4 shows a propeller arrangement with rotary table in the tunnel cross section, with a side view of the rudder propeller rotated to a transverse direction.

As is shown in FIGS. 1 and 2, the separating surface 9 may be a flat bottom of a floating body. In a propeller tunnel, the pivoting radius 10 of the nozzle requires the formation of an apical plane 11, which limits the tunnel height 12 above the baseline 13 and forms, together with the wall of the tunnel 14, the separating surface 9 for the flow, as is shown in FIG. 4.

In the embodiment according to FIG. 1, the nozzle ring 2 is held via fastening struts 15, and the profile ends 16 are cut off in parallel to the boat beneath the separating surface 9. The profile ends may, of course, also be rounded or provided with end plates.

According to FIG. 2, the profile ends 16 of the nozzle ring 2 are additionally fastened to stem 6, via a plate-like fastening element 17 which also rotates around the vertical axis 7 beneath the separating surface 9.

Figure 3:
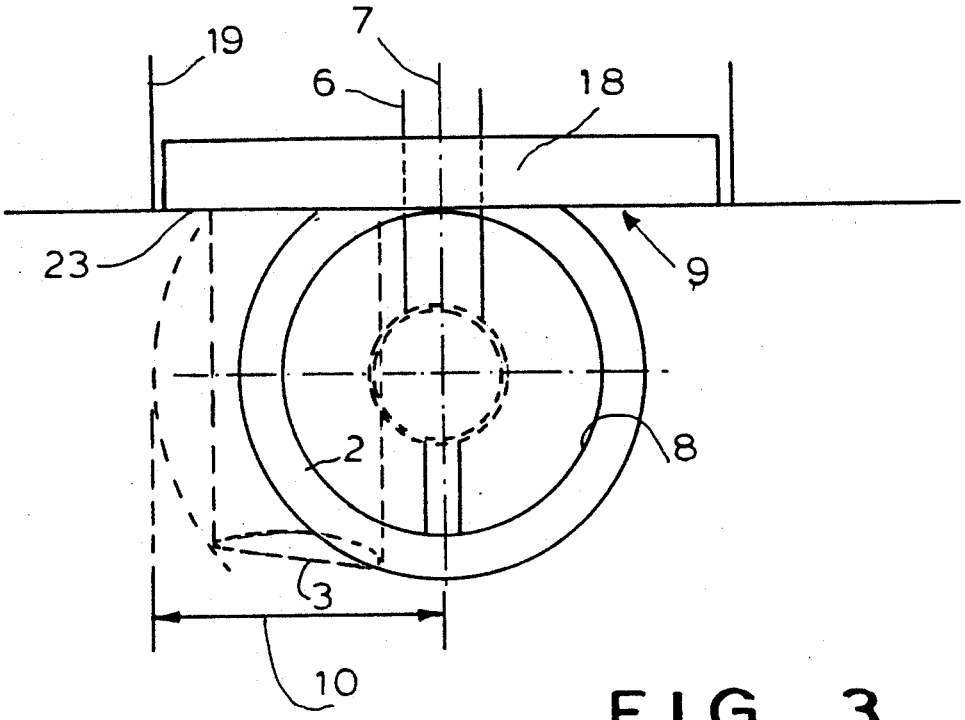
FIG. 3 shows a view of a propeller arrangement with a rotary table recessed in the boat bottom.

Another embodiment, according to FIG. 3, consists of providing a disk body as a rotary table 18, which, being part of the separating surface 9, is inserted aligned in a well 19. The rotary table 18 is arranged concentrically to the vertical axis 7 and is securely connected to the nozzle ring 2 and the rotatable stem 6. If desired, it is also possible to embed the complete nozzle ring 2 with its upper sector in the rotary table 18 such that the tangential position of the inner circle 8 of the nozzle ring is brought about.

Rotary table 18 may be sealed in the well 19 at its edge. If provisions are made for removing and installing the rotary table and nozzle from below only, well 19 may also be designed as a watertight recess in the separating surface 9.

Another embodiment, according to FIG. 4, consists of arranging the rotary table 18 in the well 19 which extends above the water line 20 and is closed via a flange cover 21 at the upper, stationary part 22 of the assembly unit. In this arrangement, the entire assembly unit can be lifted out in the upward direction together with the rotary table 18.

According to FIGS. 3 and 4, the rotary table 18 has a flat bottom 23, which is located in the apical plane 11.

Figure 5:
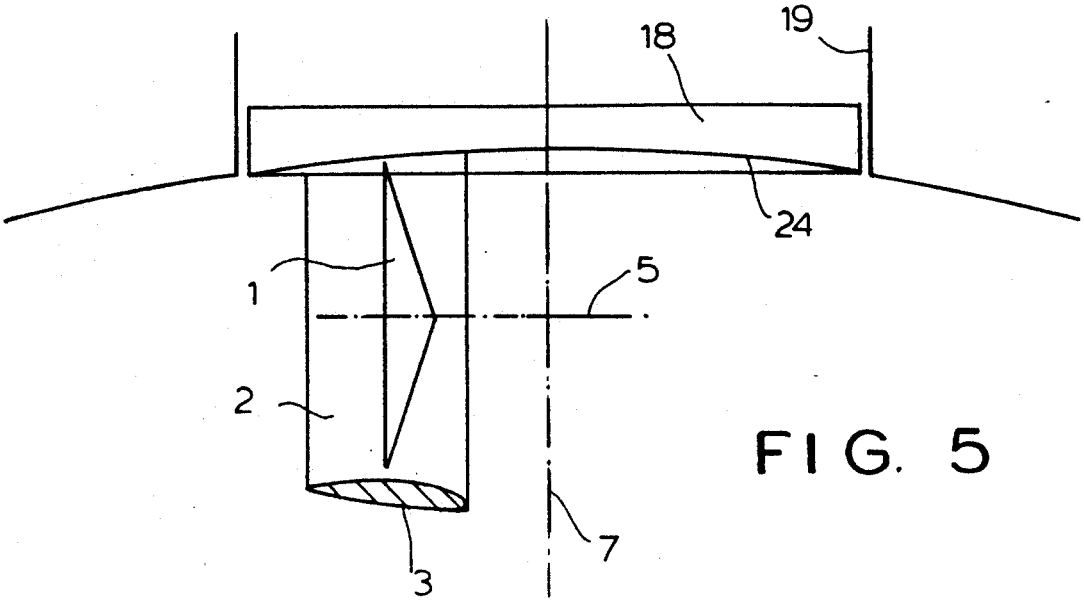
FIG. 5 shows a side view of a propeller arrangement on a rotary table with a concave bottom surface.

FIG. 5 shows an alternative design in which the bottom surface of the rotary table 18 has a concave recess 24. The recess 24 serves for better adaptation to the shape of the tunnel.

In the embodiment according to FIG. 6, the concave recess 24 is combined with a partial elevation 26 in the area of connection to the nozzle ring 2. Thus, there is a deviation from rotation symmetry in this design of the bottom surface, and it is possible to change the local tunnel shape formed by the bottom surface relative to the boat as a function of the angle of rotation around the vertical axis 7. Furthermore, a similar effect is partially achieved as with the bulge of the entire table bottom according to the embodiment shown in FIG. 7.

In the embodiment according to FIG. 7, the bottom surface of the rotary table has a convex bulge 25. This serves the purpose of influencing the vibration and cavitation characteristics of propeller 1 in the intake of the flow into the upper sector of nozzle ring 2 by narrowing the streamlines.

Figure 9:
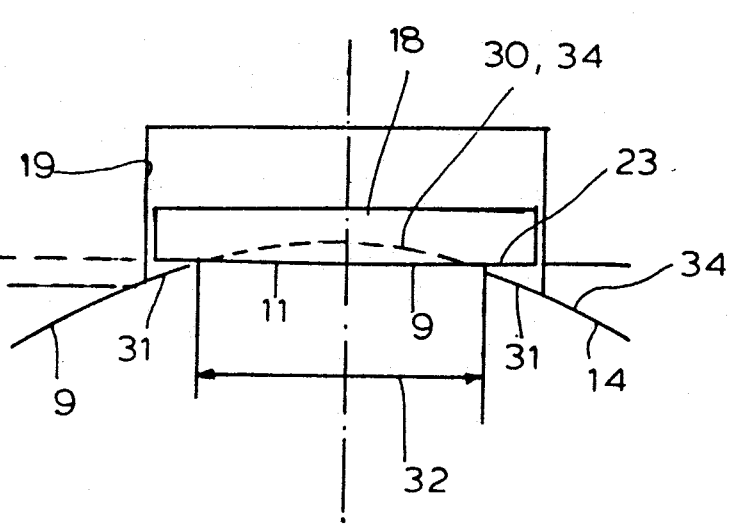
FIG. 9 shows a cross section of a flat rotary table adapted to the oval water lines of the tunnel.
Figure 8:
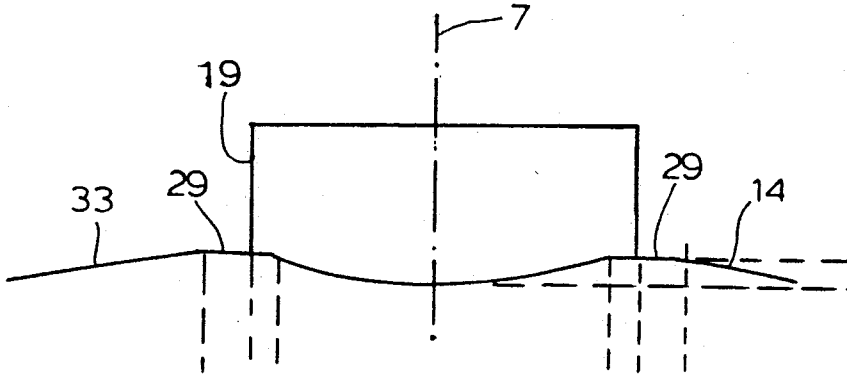
FIGS. 8 shows a longitudinal section of a flat rotary table adapted to the oval water lines of the tunnel.
Figure 10:
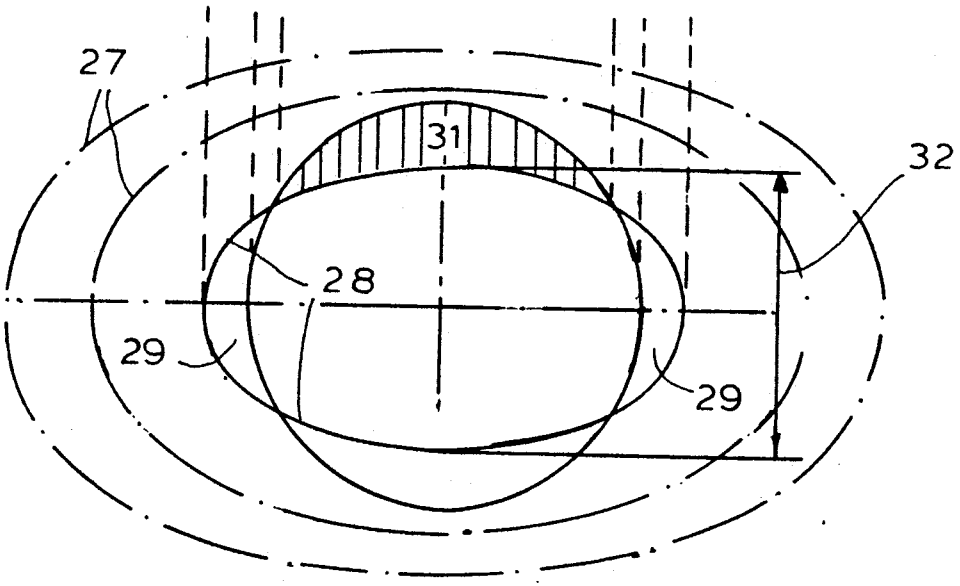
FIG. 10 shows a top view of a flat rotary table adapted to the oval water lines of the tunnel.

An arrangement according to FIGS. 8 through 10 is provided to achieve adaptation to a generally favorable oval tunnel shape. For better adaptation to the tunnel water lines 27, the apical plane 11 formed by the flat circular rotary table bottom 18 is transformed into a virtual apical plane 28 with an oval contour, which is effective for flow. To do so, apical plane 11 is extended in the longitudinal direction of the boat by sickle-shaped, flat areas 29 of the stationary tunnel wall 14, joining the well 19 in the forward and rearward directions.

At the same time, the virtual width of the apical plane is reduced. To do so, the lower edge of the well 19 is placed lower on the sides and, as shown in FIGS. 8 and 9, joined to the lateral, oblique tunnel wall somewhat below the rotary table bottom. This leads to the formation of an ideal outline 30 of the tunnel cross section (only as an imaginary line within the disk body), in whose course the segmental guide plates 31, which overlap from below and do not rotate together, are brought to the vicinity of the apical plane 11 formed by the rotary table bottom. The segmental guide plates 31, whose cross section is shown in FIG. 9, and whose top view is shown as a shaded area in FIG. 10, span over the step formed at the lower edge of the well 19, and also form part of the separating surface 9, thus generating the reduced width 32 of the virtual apical plane 28, so that the apical plane has the desired oval contour, harmonizing with the said tunnel water lines 27.

An embodiment according to FIG. 11 shows an analogous application of the segmental guide plates 31 in the case of an upwardly curved rotary table bottom with the said concave recess 24 in a tunnel cross section. As is shown by the course of the longitudinal curvature 33 of the tunnel, which is indicated by a broken line, the concave recess 24 of the rotary table bottom is approximately adapted to this slighter curvature. As a result, the sickle-shaped, flat areas 29 according to the embodiment shown in FIGS. 8 and 10 can be eliminated in front of and behind the well 19. Compensation of the greater transverse curvature 34 of the tunnel is achieved by pulling the well 19 deeper down on the sides analogously to FIG. 9 and compensating the step thus formed by the segmental guide plates 31. This leads to a virtually approximately oval shape of the rotary table bottom in this case as well.

What is claimed is:

1. In a rudder propeller for boats or floating bodies having a hull and a bottom surface, the rudder propeller having an associated nozzle to form a hydrodynamic drive that is rotatable around a vertical axis, the rudder propeller being mounted on the hull, and the drive power being transmitted by an essentially vertical stem to a bevel gear located in a hub pivotable with the stem around an axis of rotation which propels an approximately horizontal propeller shaft, the improvement wherein the nozzle comprises a nozzle ring having a gap disposed proximate said bottom surface so that the distance between the nozzle center and the outer circumference of the nozzle ring is greater than the shortest distance between the nozzle center and said bottom surface.

2. Rudder propeller in accordance with claim 1, further comprising a plate-shaped fastening element, the nozzle being connected to the stem proximate the bottom surface via said plate-shaped fastening element.

3. Rudder propeller in accordance with claim 1, further comprising a disk connected between the stem and nozzle, and disposed in a recess in the hull.

4. Rudder propeller in accordance with claim 3, wherein the disk is cylindrical and has a flat bottom.

5. Rudder propeller in accordance with one of the claims 3 or 4, wherein the disk has a concave recess on its bottom surface.

6. Rudder propeller in accordance with one of the claims 3 or 4, wherein the disk has a concave recess and has a partial elevation in the area in which the nozzle is connected to the disk.

7. Rudder propeller in accordance with one of the claims 3 or 4, wherein the disk has a convex bulge on its bottom surface.

8. In a rudder propeller for boats or floating bodies having a hull and a bottom surface, the rudder propeller having an associated nozzle to form a hydrodynamic drive that is rotatable around a vertical axis, the rudder propeller being mounted on the hull, and the drive power being transmitted by an essentially vertical stem to a bevel gear located in a hub pivotable with the stem around an axis of rotation which propels an approximately horizontal propeller shaft, the improvement wherein there is a bulge in said bottom surface defining a propeller tunnel and the nozzle comprises a nozzle ring having a gap disposed proximate said bottom surface so that said propeller is at least partially disposed within said tunnel with the distance between the nozzle center and the outer circumference of the nozzle ring being greater than the shortest distance between the nozzle center and said bottom surface.

* * * * *